United States Patent [19]

Orndorff et al.

[11] Patent Number: 4,570,754

[45] Date of Patent: Feb. 18, 1986

[54] ELEVATOR CAB WITH RETRACTABLE BUTTONS FOR PROTECTIVE PADS

[75] Inventors: Karl B. Orndorff, Bonneauville Boro; Edward F. Sherwood, Gettysburg, both of Pa.

[73] Assignee: Westinghouse Electric Corp., Pittsburgh, Pa.

[21] Appl. No.: 666,692

[22] Filed: Oct. 31, 1984

[51] Int. Cl.[4] ..... B66B 9/00

[52] U.S. Cl. ..... 187/1 R; 248/239; 248/298

[58] Field of Search ..... 187/1 R; 248/239, 298, 248/241, 307, 231.91; 211/180; 160/386 R; 24/457, 458, 514, 523, 525; 292/59, 60

[56] References Cited

U.S. PATENT DOCUMENTS

| | | | |
|---|---|---|---|
| 201,721 | 3/1878 | Thomas | 248/298 |
| 517,760 | 4/1894 | Morgan | 292/59 X |
| 1,940,084 | 12/1933 | Grasso | 292/60 |
| 2,202,811 | 6/1940 | Carney et al. | 248/298 |

FOREIGN PATENT DOCUMENTS

| | | | |
|---|---|---|---|
| 74222 | 5/1893 | Fed. Rep. of Germany | 248/231.91 |
| 21157 | of 1893 | United Kingdom | 248/231.91 |

*Primary Examiner*—Joseph J. Rolla
*Assistant Examiner*—Nils Pedersen
*Attorney, Agent, or Firm*—D. R. Lackey

[57] ABSTRACT

An elevator cab having a plurality of retractable pad buttons which are actuatable between retracted and advanced positions. In the retracted position, a head portion of the pad button is flush with the inner surface of a wall member of the cab, and in the extended position the head portion extends into the cab to provide buttons for supporting protective pads.

8 Claims, 7 Drawing Figures

ELEVATOR CAB WITH RETRACTABLE BUTTONS FOR PROTECTIVE PADS

BACKGROUND OF THE INVENTION

1. Field of the Invention

The invention relates in general to elevator cabs, and more specifically to elevator cabs having pad buttons for supporting protective pads.

2. Description of the Prior Art

Elevator cabs, in addition to transporting passengers, are often used to move furniture and other large, bulky items, which may accidentally contact and mar the walls and panels of the cab interior. Thus, when the elevator cab is to be used for this purpose, it is common to hang protective pads on the cab sidewalls, rear and front returns. The protective pads are usually mounted by portable pad hooks which are temporarily supported by the upper edges of hung wall panels, if the cab is of this type, or they may be attached to the frame which supports a drop ceiling. Portable hooks, however, are easy to misplace and lose, and thus some cabs have pad buttons which are permanently fastened to the cab walls. Permanent pad buttons are considered unsightly and undesirable for highly aesthetic cabs, and with the trend to lighter weight cabs and honeycomb wall panels, they may tear a hole in the cab wall if struck while equipment is being loaded or unloaded from the cab.

SUMMARY OF THE INVENTION

Briefly, the present invention is a new and improved elevator cab having a platform, a ceiling, and upstanding rear, sidewall and front return members. The upstanding wall members define upper edges adjacent to the ceiling. The wall members which have inner and outer surfaces located inside and outside of the cab, respectively, define horizontally spaced openings near their upper edges which receive pad buttons. The pad buttons are actuatable between retracted and advanced positions, and they each include a shaft having first and second ends, a head portion at the first end, an intermediate support member located intermediate the ends, and a limit member disposed at the second end. Outboard support structures fixed to the second surfaces of the wall members each include a wall portion, spaced from the associated outer surface of the associated upstanding wall member, which defines an opening for receiving the second end of the shaft, and surfaces which define axial limits for the shaft. In the retracted position, a surface defined by the head portion of the pad button is flush with the associated inner surface of an upstanding wall member, making it inconspicuous to passengers in the elevator cab. In the advanced position, the intermediate support member is snugly surrounded by the opening in the wall member to transfer the weight of the protective pads hung on the pad button to the wall member. The outboard support structure completes the support function, as well as defining axial limits for the retracted and extended positions of the pad button.

BRIEF DESCRIPTION OF THE DRAWINGS

The invention may be better understood and further advantages and uses thereof more readily apparent, when considered in view of the following description of exemplary embodiments, taken with the accompanying drawings, in which.

DESCRIPTION OF THE PREFERRED EMBODIMENTS

Figure 1:
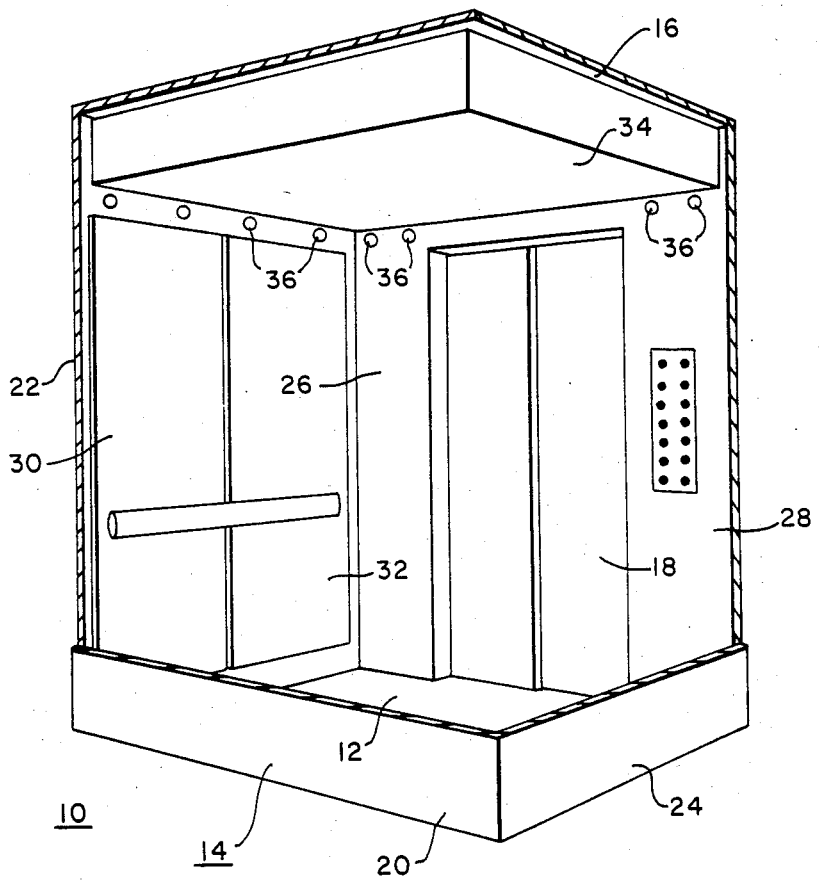
FIG. 1 is a perspective view of an elevator cab having pad buttons which may be constructed according to the teachings of the invention.

Referring now to the drawings, and to FIG. 1 in particular, there is shown an elevator cab 10 which includes a platform 12, a plurality of upstanding wall members 14, a ceiling 16, and a door 18. The upstanding wall members 14 include a rear wall 20, side walls 22 and 24, and one or more front returns, depending upon the location of door 18, such as front returns 26 and 28 disposed on either side of a centrally located door 18. Decorative panels may be hung on certain of the wall members, such as panels 30 and 32 on wall member 22, if desired. A drop ceiling 34 may conceal overhead lighting.

A plurality of horizontally spaced, retractable pad buttons 36, constructed according to the teachings of the invention, are disposed near the top edge of the upstanding walls 14, i.e., adjacent to the lowest ceiling structure, or at an otherwise convenient height, such as adjacent to the drop ceiling 34. If hung panels are utilized on the wall members, the pad buttons 36 may be disposed in the space located directly above the upper edges of the panels, and below the lowest ceiling structure.

Figure 3:
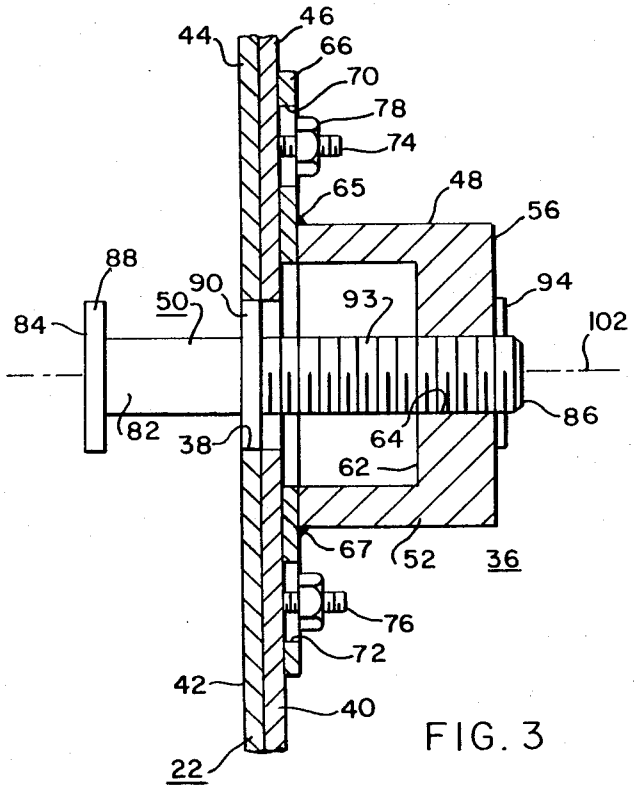
FIG. 3 is a view similar to that of FIG. 2, except with the pad button being illustrated in an extended position.
Figure 2:
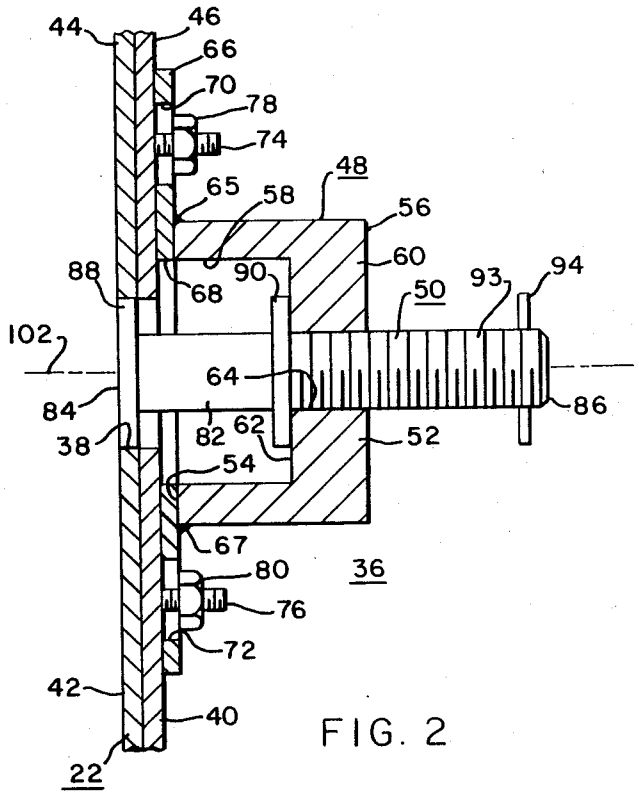
FIG. 2 is a cross sectional view, in elevation, of a pad button shown in FIG. 1, constructed according to a first embodiment of the invention, with the pad button being illustrated in a retracted position.
Figure 4:
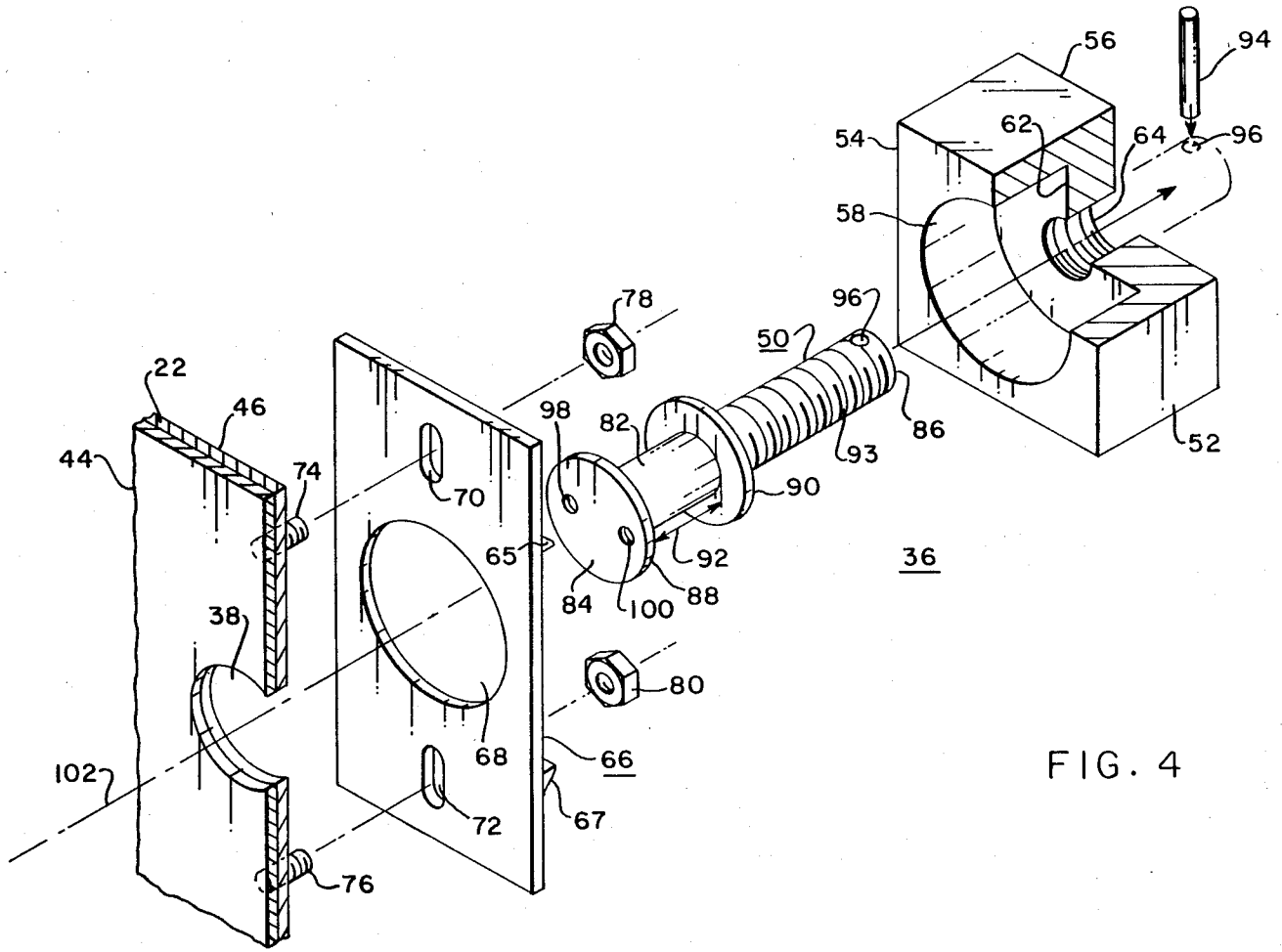
FIG. 4 is an exploded, perspective view of the pad button shown in FIGS. 2 and 3.

FIGS. 2, 3 and 4 illustrate a retractable pad button 36 constructed according to a first embodiment of the invention, with FIGS. 2 and 3 being elevational views, partially in cross section, of a retractable pad button 36 located on side wall 22. FIG. 4 is an exploded perspective view of the pad button 36 shown in FIGS. 2 and 3. FIGS. 2 and 3 illustrate pad button 36 in retracted and advanced positions, respectively.

More specifically, side wall 2 defines an opening 38 for receiving each pad button. Side wall 22 may include a metallic shell 40, such as steel or aluminum, and it may have a decorative finish 42. Side wall 22 has inner and outer surfaces 44 and 46, respectively, with inner surface 44 facing the inside of the elevator cab 10.

Pad button 36 includes a stationary outboard support structure 48 and an axially movable shaft portion 50 supported by the support structure 48. Support structure 48 includes a metallic member 52 having first and second major opposed, flat, parallel surfaces 54 and 56, with an opening 58 extending inwardly from surface 54 for a predetermined dimension towards surface 56, to create a limit wall portion 60 having a flat surface 62 which is spaced from and parallel with surface 56. Wall portion 60 defines an opening 64 which extends between surfaces 62 and 56, and which is concentric with, but smaller than, opening 58. Opening 64 is tapped.

Metallic member 52 is fixed to the outer surface 46 of wall member 22, such as by welding member 52 to a metallic plate member, indicated by welds 65 and 67, and by attaching plate member 66 to the outer surface 46 of wall member 22. Plate member 66 defines a centrally disposed opening 68 which may have the same diameter as opening 58 in metallic member 48, and it also includes openings 70 and 72. Openings 70 and 72 may be in the form of slots for adjustment purposes. Openings 70 and 72 receive threaded studs 74 and 76, respectively, which are welded to the outer surface 46 of wall member 22. Nuts 78 and 80 secure plate member 66 to studs 74 and 76, respectively.

The axially movable shaft portion 50 includes an axially extending shaft 82 having a longitudinal axis 102 and first and second axial ends 84 and 86, respectively. A head portion 88 having a diameter larger than the diameter of shaft 82 is disposed at the first axial end 84. Head portion 88 has a flat surface which forms the first end 84 of the shaft 82. An intermediate support portion 90 is disposed between ends 84 and 86, with support portion 90 having an outside diameter which is the same as the outside diameter of the head portion 88. The dimension 92 between head portion 84 and the intermediate support portion 90 determines the extension of the pad button 36 into cab 10, when the pad button 36 is in the extended position shown in FIG. 3. Shaft 82 is threaded, indicated at 93, from the intermediate support member 90 to the second axial end 86. A stop or limit member 94, such as a roll pin, is disposed through a transverse opening 96 located immediately adjacent to the second axial end 86 of shaft 82.

As shown in FIG. 2, threads 93 on shaft 82 are engaged with the threads of the tapped opening 64, with the shaft being circumferentially turned about its longitudinal axis 102 by a suitable tool, such as by utilizing indentations 98 and 100 disposed in head portion 88. Advancing shaft 82 on its longitudinal axis 102 in a direction from its first end 84 to its second end 86 is continued until the intermediate support member 90 contacts surface 62 of wall 60. Thus, the immediate support member 90 and surface 62 of wall 60 cooperatively form an axial limit when the pad button 36 is in its retracted position. When the intermediate support member 90 contacts surface 62, the surface which defines end 84 of shaft 82 will be flush with the inner surface 44 of wall member 22.

When it is desired to install protective pads, shaft 82 is circumferentially turned to advance it in a direction from its second axial end 86 towards its first axial end 84, until limit member 94 contacts end surface 56 of member 52. Thus, limit member 94 and surface 56 cooperatively define a second axial limit, which occurs when shaft 82 reaches the fully extended position shown in FIG. 3. It is important to note that when shaft 82 reaches the fully extended position, that the intermediate support member 90 is disposed snugly within opening 38. This is important, because the weight of the protective pads is transferred to the wall member 22, protecting the outboard support point provided by member 52 and the second end of shaft 82, from being subjected to excessive torque.

Figure 6:
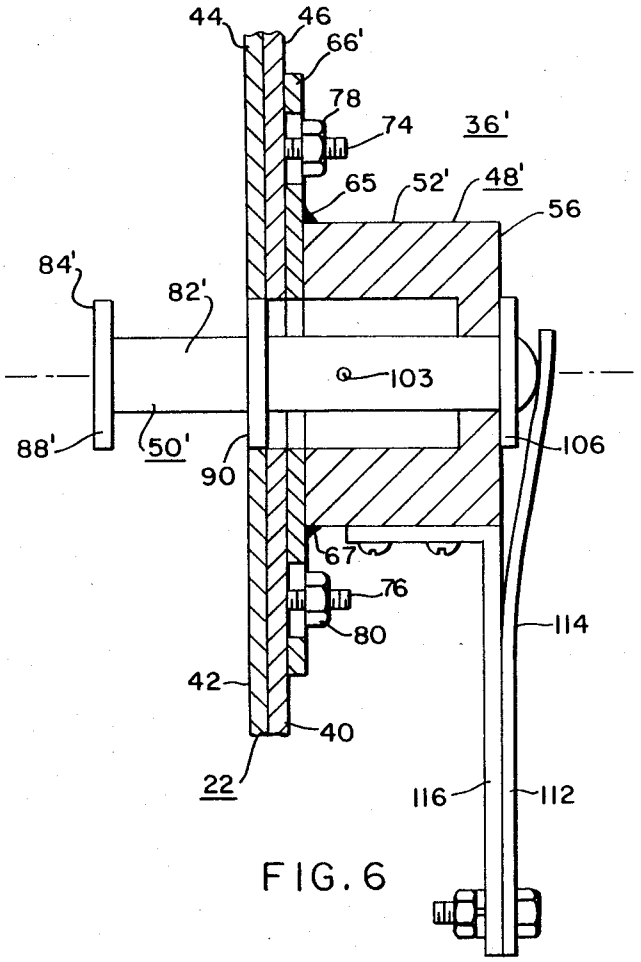
FIG. 6 is a view similar to that of FIG. 5, except with the pad button being illustrated in an extended position.
Figure 5:
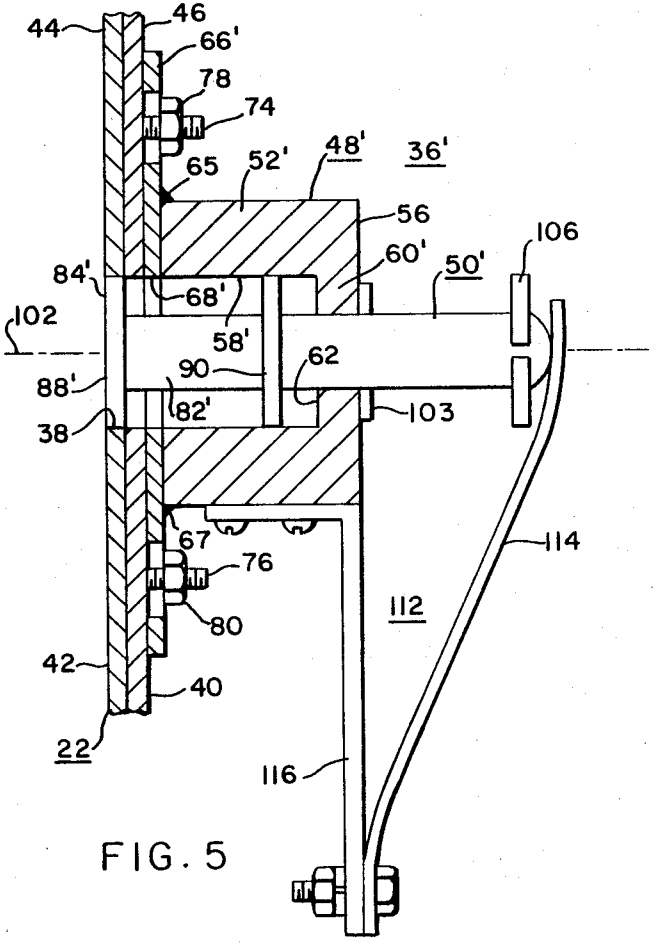
FIG. 5 is a cross sectional view, in elevation, of a pad button constructed according to another embodiment of the invention, with the pad button being illustrated in a retracted position.
Figure 7:
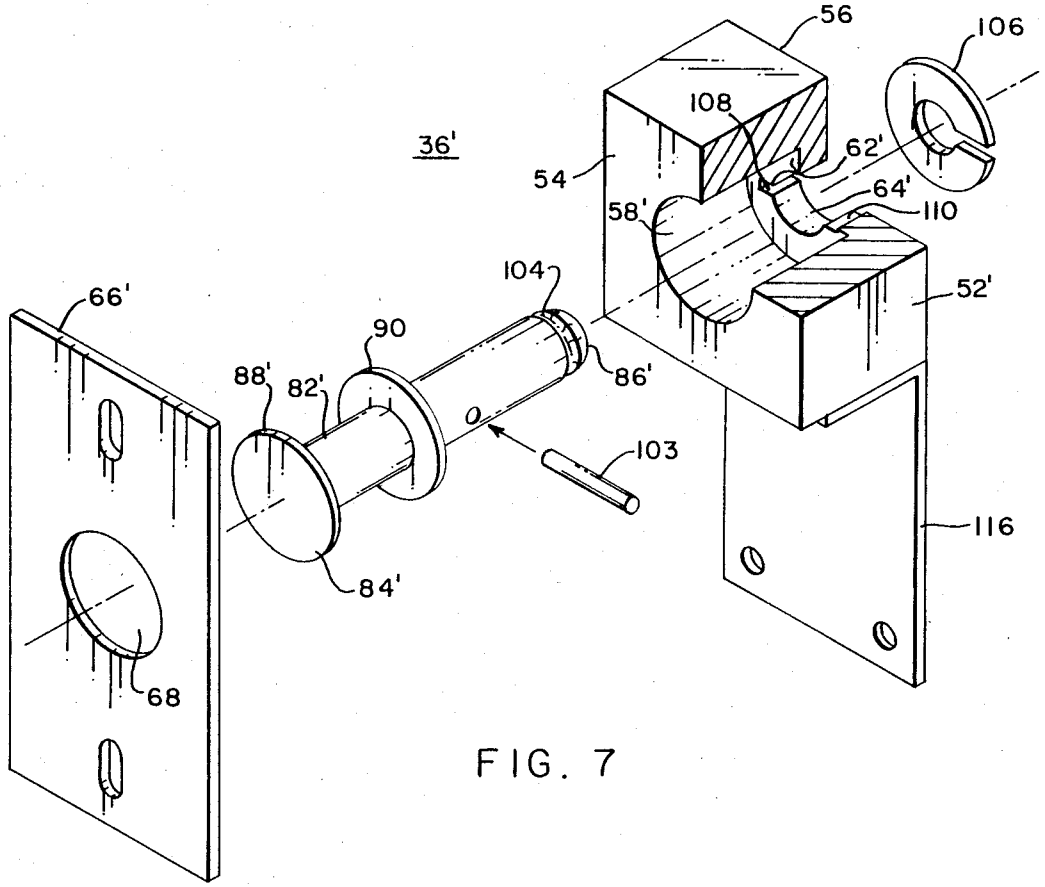
FIG. 7 is an exploded, perspective view of the pad button shown in FIGS. 5 and 6.

The embodiment of the invention shown in FIGS. 2, 3 and 4 requires a special tool, and a few minutes in order to actuate several pad buttons from one of its positions to the other. FIGS. 5, 6 and 7 illustrate an embodiment of the invention which requires no tool and very little time to actuate. FIGS. 5 and 6 are elevational views, partially in section, of a pad button 36', setting forth retracted and extended positions similar to FIGS. 2 and 3, respectively, and FIG. 7 is an exploded perspective view of pad button 36'. Elements of pad button 36' which are identical to those of pad button 36 are given the same reference numerals, and will not be described again. Modified components are identified with the same reference numbers along with a prime mark.

More specifically, pad button 36' includes a stationary outboard support structure 48' and an axially movable shaft portion 50'. Shaft portion 50' includes a shaft member 82' having spaced head and intermediate support portions 88' and 90, with head portion 88' being similar to head portion 88 except the indentations 98 and 100 for receiving a special tool are not required. Shaft 82' is modified by eliminating the threads 93, and by providing an intermediate transverse opening for receiving a key 103, such as a roll pin shaft 82' is further modified, by rounding the second end 86', and by providing a groove 104 near the second end 86 for receiving a snap ring 106.

Support structure 48' includes a metallic member 52' having first and second major flat, parallel surfaces 54 and 56, with an opening 58' extending inwardly for a predetermined dimension from surface 54 towards surface 56 to create a wall portion 60'. Wall portion 60' includes a flat surface 62' which is spaced from and parallel with surface 56. Opening 58' is sized to smoothly receive and guide intermediate support member 90. Wall portion 60' defines a smooth, i.e., untapped; keyed opening 64' which includes a round inside diameter sized to smoothly receive shaft 82', and first and second relatively thin openings 108 and 110 which are in communication with the round opening, and which form the keyed configuration of the keyed opening 62'. As illustrated, openings 108 and 110 may extend perpendicularly outward from opposite sides of the round opening, for receiving and passing key 102 in a predetermined circumferential orientation of shaft 82'.

Bias means 112 is disposed to urge shaft 82' axially from its second end 86' towards it first end 84'. In the embodiment set forth in FIGS. 5, 6 and 7, the bias means 112 includes a leaf spring 114, but other type of springs may be used. Lead spring 114 is attached to one arm of a right angle bracket member 116, with the remaining arm of the bracket member being fixed to metallic member 52'.

Spring 114 is substantially unbiased when the pad button 50' is in its extended position shown in FIG. 6. Pushing shaft 82' axially inward from end 84', and turning shaft 82 to align key 103 with the keyed opening 64 advances the key 103 through the keyed opening. Turning the shaft 90 degrees will now prevent the key 103 from returning through the keyed opening, with the bias means 112 pressing key 103 against surface 56 to provide an axial stop for the retracted position shown in FIG. 5. When key 103 is pressed against surface 56, the surface which defines end 84 of head portion 88' will be flush with the inner surface 44 of the associated wall member 22.

To release the shaft 82' of pad button 36' from the retracted configuration shown in FIG. 5, it is only necessary to press the head portion 88' inwardly while turning the head portion 90 degrees or until aligning the key 103 with the keyed opening 64'. Releasing the pad button will then cause the shaft to advance to the position shown in FIG. 6, with the snap ring or limit member 106 contacting surface 56 to stop the shaft 82'. The intermediate support member 90 is now disposed snugly within opening 38 of wall member 22. Plate member 66' is similar to plate member 66, except opening 68' is sized to continue the guiding function of opening 58'.

We claim as our invention:

1. An elevator cab, comprising:

a platform, upstanding wall members on said platform having first surfaces which define the inside of the cab, second surfaces outside the cab and upper horizontally extending edges, said upstanding wall members defining a plurality of openings disposed in spaced relation near their upper edges, and a pad button disposed in each of said openings, each of said pad buttons including a shaft having first and second ends, a head portion at said first end, and a support portion intermediate said first and second ends, said head and intermediate portions having diameters sized to slidably enter the associated opening, said pad button being operable between advanced and retracted positions, said head portion defining a surface which is flush with the first surface of its associated side wall portion when in the retracted position, with the remaining portion of said pad button extending outwardly from the associated second surface, said head portion extending into the cab, in the advanced position of the pad button, with said intermediate support portion entering the associated opening to transfer load applied near the first end of the shaft to the associated wall portion.

2. The elevator cab of claim 1 wherein the shaft is threaded adjacent to its second end, the head includes means for imparting rotary motion to the shaft, and including outer support means spaced from the second surface of the associated side portion having a tapped opening for receiving the threaded second end of the shaft.

3. The elevator cab of claim 2 wherein the outer support means and the support portion of the shaft cooperate to provide an axial limit when the pad button reaches its retracted position.

4. The elevator cab of claim 2 including a stop member fixed near the second end of the shaft, with said stop member and said outer support means cooperatively providing an axial limit when the pad button reaches its extended position.

5. The elevator cab of claim 1 including bias means for urging the shaft axially in a direction from its second end to its first end, and means for providing first and second axial limits when the pad button is respectively retracted and advanced.

6. The elevator cab of claim 5 wherein the means which provides at least one of the axial limits includes a limit wall having a keyed opening therein, and a key on the shaft.

7. The elevator cab of claim 6 wherein the means which provides the remaining axial limit includes a limit member fixed near the second end of the shaft which cooperates with the limit wall.

8. The elevator cab of claim 1 wherein the shaft includes a key fixed intermediate its first and second ends, and a limit member fixed adjacent to its second end, and including:

outer support means including a limit wall having first and second major opposed flat surfaces, with the first major surface being spaced from the second surface of the associated upstanding wall member, said limit wall defining a keyed opening which extends between its first and second ends, for receiving said shaft key in predetermined circumferential positions of the shaft, and bias means for urging the shaft axially in a direction from its second end towards its first end, with the key and limit member respectively cooperating with the second major surface of said limit wall to provide first and second axial limits when the pad button is retracted and advanced.

* * * * *